United States Patent [19]

Saunders

[11] 4,131,236

[45] Dec. 26, 1978

[54] HIGH VELOCITY LIQUID JET CUTTING NOZZLE

[75] Inventor: David H. Saunders, Cranfield, England

[73] Assignee: The British Hydromechanics Research Association, Cranfield, England

[21] Appl. No.: 751,718

[22] Filed: Dec. 17, 1976

[30] Foreign Application Priority Data

Dec. 24, 1975 [GB] United Kingdom ..... 52891/75
Jun. 15, 1976 [GB] United Kingdom ..... 24751/76

[51] Int. Cl.[2] ..... B05B 1/00

[52] U.S. Cl. ..... 239/589; 175/422; 239/596; 239/600

[58] Field of Search ..... 299/17; 175/67, 422, 175/65; 239/589, 596, 600–602

[56] References Cited

U.S. PATENT DOCUMENTS

| | | | |
|---|---|---|---|
| 2,107,601 | 2/1938 | Davis | 239/600 X |
| 3,705,693 | 12/1972 | Franz | 239/602 X |
| 3,750,961 | 8/1973 | Franz | 239/596 X |

FOREIGN PATENT DOCUMENTS

| | | | |
|---|---|---|---|
| 607179 | 10/1960 | Canada | 239/602 |

*Primary Examiner*—Evon C. Blunk
*Assistant Examiner*—Andres Kashnikow
*Attorney, Agent, or Firm*—Blanchard, Flynn, Thiel, Boutell & Tanis

[57] ABSTRACT

A high velocity liquid jet cutting nozzle in which a nozzle member is supported in communicative connection with the outlet end of a high pressure liquid pipe by means of a mounting which is seated in a cup-shaped holder which is connected to the outlet end of the pipe.

To provide a coherent, stable jet at liquid pressures of the order of 60,000 psi, the nozzle member is formed from a piece of artificial sapphire, such as a watch or instrument jewel, having a circular aperture diameter of between 0.05mm. and 0.40mm. This aperture is formed with a convergent inlet portion which is a surface of revolution, about the axis of the aperture, of a smooth curved arc, a uniform diameter portion extending tangentially from the inlet portion, and a divergently bevelled outlet portion.

14 Claims, 5 Drawing Figures

HIGH VELOCITY LIQUID JET CUTTING NOZZLE

BACKGROUND OF THE INVENTION

The invention relates to liquid jet cutting apparatus and, in particular, to a nozzle member for use in the formation of high velocity liquid jets in such apparatus.

For liquid jet cutting applications, very fine liquid jets are required and various materials have been used to produce nozzle members through which liquid at high pressure is forced. Materials used for these nozzle members have included metals, ceramic materials such as tungsten carbide, diamond and artificial jewels such as artificial sapphires. One of the most successful materials for use as a nozzle member, at pressures of up to 60,000 psi, has been sapphire which combines the desirable properties of strength and smooth surface finish. Artificial sapphire is available in the form of watch and instrument jewels, and some of these components are suitable, or can be modified, for use as nozzle members to produce high pressure liquid jets.

Thus, very fine jets of liquid, at pressures of up to 60,000 psi, are formed by passing the liquids through a nozzle member comprising a piece of artificial sapphire formed with a circular aperture having a diameter which is determined by the requirements of the material to be cut and is typically within the range of 0.05 mm to 0.40 mm.

The normal requirements for precision cutting with high pressure liquid jets are:

1. Good finish to cut edges;
2. Sufficient depth of good quality cut; and
3. Narrow cut. To fulfill these requirements, the energy contained in the jet must be concentrated in as small an area of the material being cut as possible. The jet must therefore be stable and non-oscillatory, with a minimum of expansion along its exposed length and it should not break up into spray or droplets. Surface roughness of any region of the internal surface of the aperture through the nozzle member which is exposed to high velocity flow of liquid is an important factor in determining the level of disturbance present in the jet as it leaves the nozzle member and, therefore, in determining the performance of the jet cutting apparatus.

It has been found that in the typical range of aperture diameters in nozzle members used for precision jet cutting, a high degree of polish of the nozzle member surfaces is difficult to achieve with many materials. With some aperture shapes, polishing is complicated by the relative inaccessibility of some of the internal surfaces. As poor surface finish can also result in local cavitation in the liquid flowing through the aperture in the nozzle member and this can further damage the internal surface of the aperture, jet performance is unreliable.

One solution, that has been applied with materials which can be polished to a sufficient degree, is to produce the liquid jet by passing the liquid through an orifice member having an orifice which prevents the liquid from contacting the inaccessible internal surface of the orifice by causing the liquid to separate from the internal surface of the orifice at a sharp junction formed between the inlet portion of the internal surface and the inaccessible surface. The disadvantage of this method is that the "quality" of the jet produced is extremely dependent on the surface finish at this junction, which is highly stressed in operation and therefore liable to sudden failure.

SUMMARY OF THE INVENTION

It is an object of the present invention to overcome the disadvantages of the use of such an orifice by providing a nozzle member having an aperture with an internal surface which is more easily polished than in known orifice members and which is capable of providing a liquid jet suitable for precision cutting with a high pressure liquid jet.

According to the invention, there is provided a nozzle member, for use in the formation of high velocity liquid jets in liquid jet cutting apparatus, comprising a piece of artificial sapphire formed with a circular, internally polished aperture, in which the aperture has a convergent inlet portion, a uniform diameter intermediate portion extending from the inlet portion and having a length of one-quarter to five times, and preferably one half to four times, said diameter, and a divergently bevelled outlet portion, the inlet portion being formed as a surface of revolution, about the axis of the aperture, of a smooth curved arc which blends tangentially into the intermediate portion.

The smooth curved arc may be described, at least approximately by the general relationship:

$$(D/d) = [1 + A(Y/d)^B]$$

where Y is a dimension measured from the junction of the inlet and intermediate portions, in the direction of the axis through the aperture toward the inlet, D is the diameter of the inlet portion at Y, d is the diameter of the intermediate portion, and A and B are constants, where $0<A<6$ and $B>1$.

In a preferred embodiment of the invention, the length of the intermediate portion is greater than 0.25 d but less than 5.0 d and the values of the constants A and B lie within the following limits:

$$0.4 < A < 1.6$$

$$1.2 < B < 1.8$$

and the inlet end of the inlet portion has a diameter in excess of 2.0 d.

Jewels such as this are small and are difficult to hold in position so as to prevent leakage flow bypassing the nozzle members which they form. Such leakage, if it occurs, can reduce the cutting ability of the jet and can also cause damage to the material of the nozzle member and to the material of the mounting for the nozzle member.

One solution which has been adopted to support a synthetic sapphire nozzle member is to press or glue the nozzle member into a metal mounting which is large enough to be held by conventional means which involve metal-to-metal contact and may be supplemented by the use of an elastomerically deformable sealing ring. However, whenever a nozzle member becomes worn or damaged in use and must be discarded, the mounting must also be discarded.

It is therefore a further object of the present invention to provide a mounting for a nozzle member of a liquid jet cutting apparatus, which is re-usable without the need for substantial repair or reconditioning.

Thus, the invention also provides a re-usable mounting, for a nozzle member of a liquid jet cutting apparatus, comprising two or more separable body members, fastening means for releasably securing the body members together, an aperture extending through the body members and formed with an internal step for seating a co-axially arranged nozzle member, and a sleeve which is co-axially disposed within the aperture for pressing the nozzle member on to the step.

Additional adjusting means may be provided for pressing the sleeve towards the step or, alternatively, the fastening means securing two body members may be used to press the sleeve and the step formed in the aperture towards each other. In either form of construction, the use of a resiliently deformable component for all or part of the sleeve is preferred in that it reduces damage to the nozzle member during dimensional changes in the mounting during pressurisation.

In one form of a construction, the mounting is split so that part of the surface of one of the body members forms the step on which the nozzle member is seated and so can be lapped smooth, thus providing a good seal with the polished surface of the nozzle member so as to prevent leakage flow passing around the nozzle member. With this construction, leakage to atmosphere between the split sections forming the body members of the mounting can be prevented if the abutting surfaces of both such members are lapped. An improved seal, to prevent leakage both around the orifice member and to atmosphere, can be achieved by the inclusion of one or more sealing rings of elastomerically deformable material such as rubber "0" rings.

In an alternative form of construction, a small disposable washer of deformable material is inserted into the mounting and, when fluid pressure is applied, the nozzle member becomes embedded in this disposable washer so as to provide a good seal which prevents leakage flow passing around the nozzle member. If the disposable washer has a larger diameter than the nozzle member, a good seal can also be provided between split sections of the mounting, thus preventing leakage to atmosphere.

DESCRIPTION OF THE DRAWINGS

A nozzle member embodying the present invention and three embodiments of a high velocity liquid jet nozzle incorporating this nozzle member are hereinafter described, by way of example, with reference to the accompanying drawing, in which.

DESCRIPTION OF PREFERRED EMBODIMENTS

Figure 1:
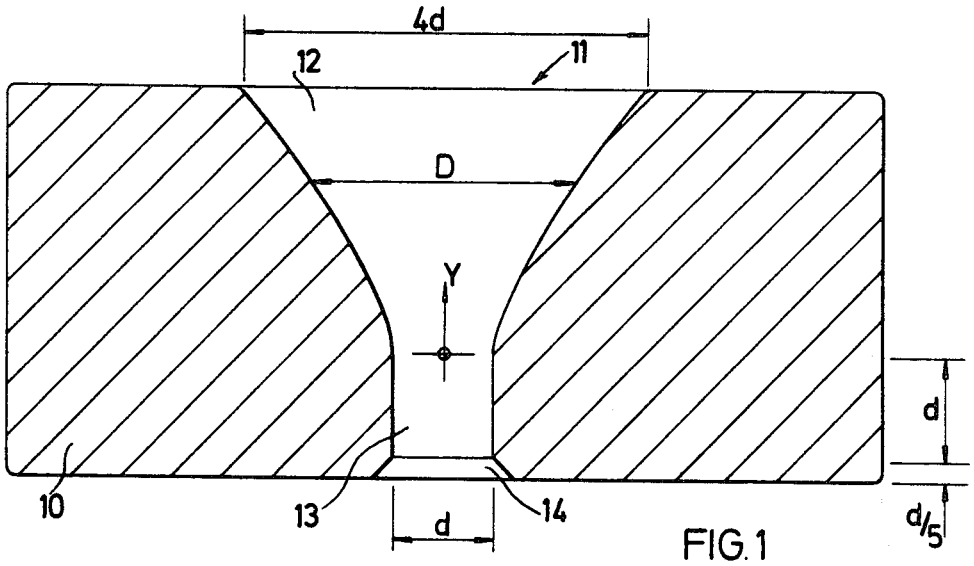
FIG. 1 is a cross-sectional elevation of the nozzle member.

As shown in FIG. 1, the nozzle member 10 is formed with a circular section aperture 11 having polished internal surfaces. The aperture 11 has a convergent inlet portion 12 which, in cross-section, has an arcuate profile described by the relationship $(D/d) = [1 + 0.8 (Y/d)^{1.4}]$, where Y is a dimension measured from the junction of the inlet portion 12 and an intermediate portion 13, D is the diameter of the inlet portion 12 at Y, and d is the diameter of the intermediate portion 13. In the embodiment illustrated in FIG. 1, the diameter of the inlet end of the inlet portion 12 is four times the diameter d. The inlet portion 12, the arcuate profile of which is defined about an average radius which is approximately three times the diameter of the intermediate portion, blends or merges tangentially with the intermediate portion 13 which has a length equal to the diameter d. Finally, the aperture 11 has a divergently bevelled outlet portion 14 having a length of d/5. The outlet portion 14, as shown in FIG. 1, has a sharp junction with the intermediate portion 13.

With configurations such as this, there is improved access to the internal surfaces of the aperture for polishing purposes, even at the intermediate portion of the aperture. Moreover, it has been found that the jet of high pressure liquid issuing from the intermediate portion of the aperture leaves the internal surface of the outlet portion of the aperture without significant disturbance to the jet which therefore remains stable and coherent. Oscillatory motion of the jet is almost entirely eliminated and the formation of spray as a result of water particles separating from the jet is considerably reduced. Erosion of the nozzle member is also substantially reduced when the internal surfaces of the inlet portion and intermediate portion are highly polished.

Figure 2:
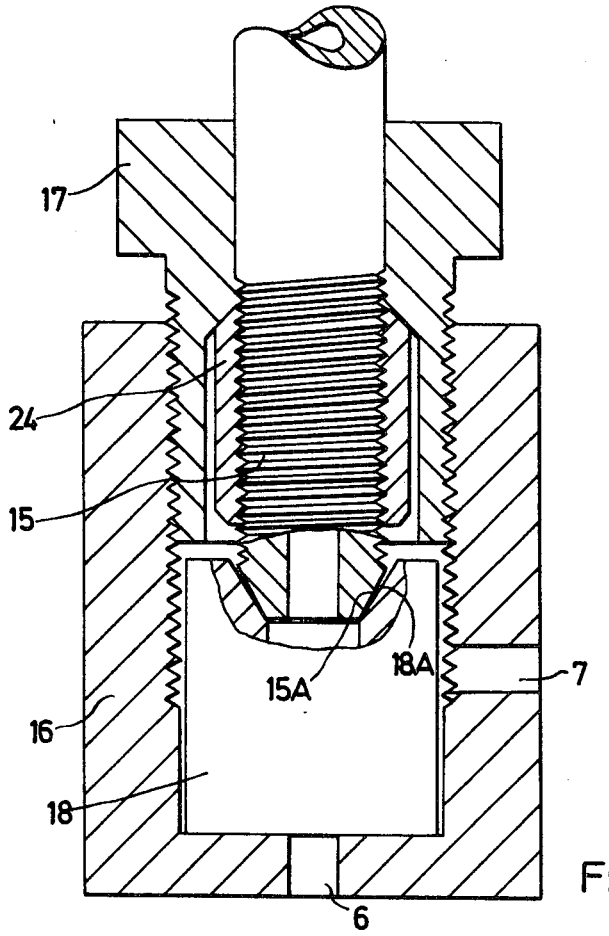
FIG. 2 is a cross-sectional elevation of the high velocity liquid jet nozzle which is fitted to a high pressure water pipe in a conventional manner and incorporates a nozzle member such as that illustrated in FIG. 1 and a re-usable mounting for this nozzle member.

As shown in FIG. 2, a re-usable mounting 18 (shown schematically) is inserted in a cup-shaped holder 16 and a gland nut 17 having screw-threaded engagement with the holder 16 secures the mounting 18 in position. A collar 24 having screw-threaded engagement with the external periphery of a high pressure water pipe 15, which has a tapered end surface 15A, bears on an internal abutment formed in the gland nut 17 and presses the tapered end 15A of the pipe 15 into a frusto-conically convergent inlet surface 18A formed in the mounting 18. When the gland nut 17 is tightened sufficiently to seal the joint between surfaces 15A and 18A, the mounting 18 is firmly held against the base of the holder 16 so as to prevent leakage to atmosphere.

High pressure water passes through a nozzle member which is held within the mounting 18 and issues from the mounting in a high pressure jet which passes through an outlet aperture 6 formed in the holder 16. A vent 7 is formed in the holder 16 to prevent pressure build-up inside the holder 16, in the event of minor leakage to atmosphere.

Figure 3:
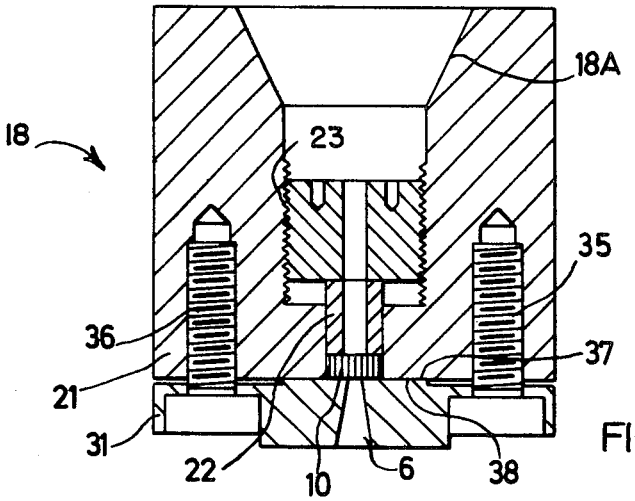
FIG. 3 is a sectional side view of one form of the re-usable mounting shown in FIG. 2.

As shown in FIG. 3, the mounting 18 has two separable body members 21 and 31 which are held together for assembly by screws 35 and 36. A small nozzle member 10 is held against the lower member by a sleeve 22 which is, in turn, held by a retaining screw 23 which is screwed into the upper member 21. An outlet aperture 6 for the high velocity liquid jet is provided in the lower member 31 and, as shown, this aperture is smaller in diameter than the nozzle member 10, so as to provide the required supporting step for seating the nozzle member 10. The adjoining surfaces 37 and 38 of the two members 21 and 31 can be lapped and polished to provide a good seal. The area of contact between surfaces 37 and 38 is sufficient to ensure that, when the mounting is firmly held against a high pressure water pipe, leakage of pressurised water is prevented under all conditions of operation.

Figure 4:
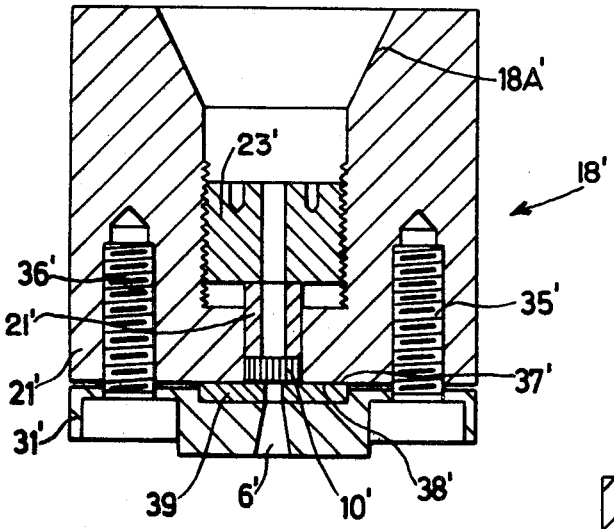
FIG. 4 is a sectional side view of a further modified form of re-usable mounting having a disposable washer of deformable material.

FIG. 4 illustrates a modification of the mounting 18' wherein the parts corresponding to those shown in FIG. 3 have been designated by the same reference numerals but with the addition of a prime (') thereto.

As shown in FIG. 4, leakage is prevented by a disposable sealing washer 39 of deformable material which is inserted into a recess formed in the lower member 31' of the mounting. In this case, the upper annular area surrounding the aperture through the washer 39 forms the supporting step in the axial aperture by which the high pressure liquid passes through the mounting. Thus, when the mounting is firmly held against a high pressure water pipe, and the upper member 21' is pressed against the lower member 31', a seal is formed between the abutting surfaces 37' and 38' of the upper member 21' and the washer 39 as the washer 39 is deformed and the nozzle member 10' is embedded in the sealing washer 39 so as to prevent leakage of high pressure water. Alternatively, if retaining screw 23' is not tightened prior to fitting of the mounting to a high pressure water pipe, the nozzle member 10' becomes embedded in the sealing washer 39 on application of water pressure on top of the nozzle member 10' during operation.

Figure 5:
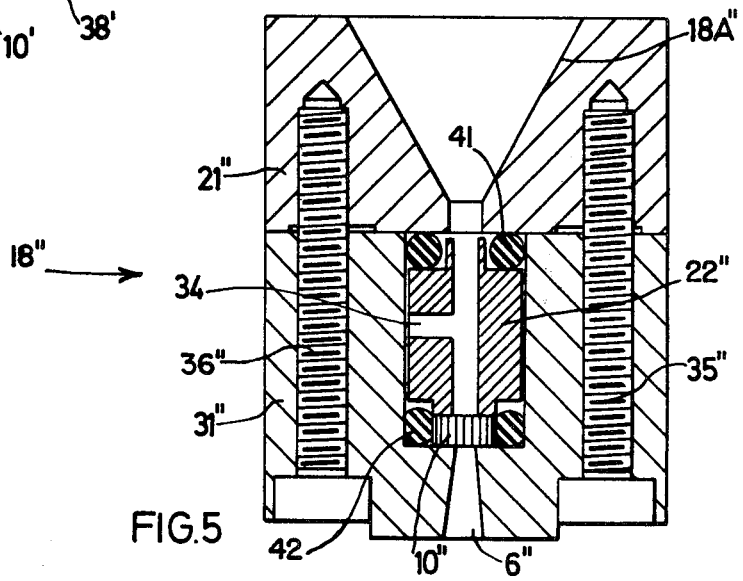
FIG. 5 is a sectional side view of a third form of re-usable mounting which contains resiliently deformable seals to prevent leakage and in which a nozzle member is held in position by elastomerically deformable means.

FIG. 5 illustrates still a further embodiment of the mounting 18" wherein the parts thereof have been designated by the same reference numerals utilized to designate the corresponding parts in FIG. 3 but with the addition of a double prime (") thereto.

As shown in FIG. 5, the nozzle member 10" is seated on an internal step formed in the aperture passing through the lower member 31" of the mounting 18" and is pressed against this internal step by a sleeve 22" and a rubber "0" ring 41 which seats on a shouldered portion at the upper end of the sleeve 22" and bears against the adjacent surface of the upper member 21" of the mounting. A further rubber "0" ring 42 surrounds the nozzle member 10" and is radially compressed between the nozzle member 10" and the surface of the axial aperture extending through the mounting. A radial vent 34 from the centre of the sleeve 22" bleeds high pressure liquid to the outside of the sleeve 22" and to the space above the "0" ring 42 to press this "0" ring 42 against the internal step supporting the nozzle member 10" so as to prevent radial leakage of high pressure water. The "0" ring 41 also prevents radial leakage of high pressure water between the separable upper and lower members 21" and 31" of the mounting.

Having defined my invention, I claim:

1. A high velocity liquid jet nozzle, for use in a liquid jet cutting apparatus, comprising:

a high pressure liquid pipe having an outlet for the supply of high pressure liquid;

a cup-shaped holder connected to the high pressure liquid pipe;

a mounting seated in the holder and attached to the outlet of the high pressure liquid pipe; and a nozzle member supported by the mounting in communicative connection with the outlet of the high pressure liquid pipe, for use in the formation of a high velocity jet of liquid from the high pressure liquid pipe, in which:

a piece of artificial sapphire is formed with a circular, internally polished aperture;

the aperture has a convergent inlet portion, a uniform diameter intermediate portion extending from the inlet portion and having a length of one-quarter to five times said diameter, and a divergently bevelled outlet portion;

the inlet portion is formed as a surface of revolution about the axis of the aperture, of a smooth curved arc which blends tangentially into the intermediate portion;

the intermediate portion is formed as a surface of revolution, about the axis of the aperture; and the outlet portion is formed as a surface of revolution, about the axis of the aperture, making a sharp junction with the intermediate portion, and the angle of divergence of said lastmentioned surface is sufficiently great to ensure that a jet of high pressure liquid issuing from the intermediate portion of the aperture leaves the surface of the outlet portion without significant disturbance to the jet;

wherein the mounting supporting the nozzle member is a reusable mounting which is removably supported within said cupshaped housing and comprises at least two separable body members connected together, fastening means for releasably securing the body members together, an aperture extending through the body members and formed with an internal step on which the nozzle member is seated so that the nozzle aperture is in co-axial alignment with the mounting aperture, said apertures in turn being in co-axial alignment with the outlet of said pipe, and a separable sleeve which is mounted on a said body member and is co-axially disposed within the mounting aperture for pressing the nozzle member onto the step.

2. A nozzle, according to claim 1, in which the smooth curved arc is approximated by the general relationship $(D/d) = [1 + A(Y/d)^B]$ where Y is a dimension measured from the junction of the inlet and intermediate portions, in the direction of the axis through the aperture, D is the diameter of the inlet portion at Y, d is the diameter of the intermediate portion of the aperture, and A and B are constants, where $0<A<6$ and $B>1$.

3. A nozzle, according to claim 1, comprising adjusting means for pressing the sleeve towards the step.

4. A nozzle, according to claim 1, in which the sleeve is supported by one of the separable body members and the internal step is provided by the other of the separable body members so that the sleeve is pressed towards the step by the fastening means for releasably securing the body members.

5. A nozzle, according to claim 1, in which:

the internal step is provided at a change in cross-sectional area in the mounting aperture passing through one of the separable body members; and an elastomerically deformable sealing ring is provided axially between the other one of the body members and the sleeve.

6. A nozzle, according to claim 5, in which further elastomerically deformable sealing ring surrounds the nozzle member and is radially compressed between the nozzle member and the periphery of the aperture through said one of the separable body members.

7. A nozzle, according to claim 6, in which the sleeve is formed with a radial duct to allow high pressure liquid to bleed into a space between the sleeve and the radially compressed sealing ring to press the radially compressed sealing ring onto the internal step so as to prevent leakage of liquid between the nozzle member and the step.

8. A nozzle, according to claim 1, in which the aperture through one of the separable body members is smaller than the aperture through the other separable body member so that part of the surface of said one body member provides the internal step on which the nozzle member is seated.

9. A nozzle, according to claim 8, in which the two adjacent body members have engageable surfaces which abut each other and at least one of these surfaces, on said one of the separable body members, is lapped smooth so as to provide a good seal with the polished surface of the nozzle member.

10. A nozzle, according to claim 1, in which a disposable washer of deformable material is supported by one of the separable body members so as to provide the internal step on which the nozzle member is seated, the sleeve being mounted on the other body member, and the nozzle being axially held between the disposable washer and the sleeve.

11. A high velocity liquid jet nozzle, for use in a liquid jet cutting apparatus, comprising:

a high pressure liquid pipe having an outlet for the supply of high pressure liquid;

a cup-shaped holder connected to the high pressure liquid pipe;

a mounting seated in the holder and attached to the outlet of the high pressure liquid pipe; and a nozzle member supported by the mounting in communicative connection with the outlet of the high pressure liquid pipe, for use in the formation of a high velocity jet of liquid from the high pressure liquid pipe, in which:

a piece of artificial sapphire is formed with a circular, internally polished aperature, the aperture has a convergent inlet portion, a uniform diameter intermediate portion extending from the inlet portion and having a length of one-quarter to five times said diameter, and a divergently bevelled outlet portion, the inlet portion is formed as a surface of revolution, about the axis of the aperture, of a smooth curved arc which blends tangentially into the intermediate portion, and the smooth curved arc is approximated by the general relationship $(D/d) = [1 + A(Y/d)^B]$ where Y is a dimension measured from the junction of the inlet and intermediate portions, in the direction of the axis through the aperture, D is the diameter of the inlet portion at Y, d is the diameter of the intermediate portion of the aperture, and A and B are constants, where $O<A<6$ and $B>1$.

12. A nozzle, according to claim 11, where, in the general relationship, $0.4<A<1.6$ and $1.2<B<1.8$.

13. A high velocity liquid jet nozzle, for use in a liquid jet cutting apparatus, comprising:

a high pressure liquid pipe having an outlet for the supply of high pressure liquid;

a cup-shaped holder connected to the high pressure liquid pipe;

a mounting seated in the holder and attached to the outlet of the high pressure liquid pipe; and a nozzle member supported by the mounting in communicative connection with the outlet of the high pressure liquid pipe, for use in the formation of a high velocity jet of liquid from the high pressure liquid pipe, in which:

a piece of artificial sapphire is formed with a circular, internally polished aperture, the aperture has a convergent inlet portion, a uniform diameter intermediate portion extending from the inlet portion and having a length which approximately equals said diameter, and a divergently bevelled outlet portion, and the inlet portion is formed as a surface of revolution, about the axis of the aperture, of a smooth curved arc which is approximately three times the diameter of the intermediate portion and which blends tangentially into the intermediate portion.

14. A high velocity liquid jet nozzle, for use in jet cutting apparatus, comprising:

a high pressure liquid pipe having an outlet for the supply of high pressure liquid;

a collar attached to the outside surface of the high pressure liquid pipe;

a gland nut having an inwardly directed flange which engages the end of said collar remote from the outlet of the high pressure liquid pipe, the gland nut also having an externally screw-threaded sleeve;

a cup-shaped holder having an internally screw-threaded portion engaged with the externally screw-threaded sleeve;

a mounting seated in the holder and attached to the outlet of the high pressure liquid pipe; and a nozzle member supported by the mounting in communicative connection with the outlet of the high pressure liquid pipe, for use in the formation of a high velocity jet of liquid from the high pressure liquid pipe, in which:

a piece of artificial sapphire is formed with a circular, internally polished aperture;

the aperture has a convergent inlet portion, a uniform diameter intermediate portion extending from the inlet portion and having a length of one-quarter to five times said diameter, and a divergently bevelled outlet portion; and the inlet portion is formed as a surface of revolution, about the axis of the aperture, of a smooth curved arc which blends tangentially into the intermediate portion.

* * * * *